US011044999B2

(12) United States Patent
Chang et al.

(10) Patent No.: US 11,044,999 B2
(45) Date of Patent: Jun. 29, 2021

(54) SWING CHAIR

(71) Applicant: Acer Incorporated, New Taipei (TW)

(72) Inventors: Kai-Lin Chang, New Taipei (TW); Yan-Lin Kuo, New Taipei (TW); Chao-Di Shen, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/677,643

(22) Filed: Nov. 7, 2019

(65) Prior Publication Data

US 2020/0196761 A1 Jun. 25, 2020

(30) Foreign Application Priority Data

Dec. 24, 2018 (TW) ..... 107146725

(51) Int. Cl.
*A47C 3/025* (2006.01)
*A61G 5/10* (2006.01)

(52) U.S. Cl.
CPC ..... *A47C 3/0251* (2018.08); *A47C 3/0255* (2013.01); *A61G 5/1075* (2013.01)

(58) Field of Classification Search
CPC ..... A47C 3/0251; A47C 3/0255; A47C 3/026; A47C 3/025; A61G 5/1075
USPC ..... 297/260.2, 313, 314, 330, 217.3, 217.4; 52/9, 10; 472/96, 97, 118, 119
See application file for complete search history.

(56) References Cited

U.S. PATENT DOCUMENTS 4,431,157 A * 2/1984 Arild ..... A47C 7/4454 248/583
4,478,407 A * 10/1984 Manabe ..... A63F 9/14 472/60
4,584,896 A * 4/1986 Letovsky ..... A63G 31/16 434/55
5,533,935 A * 7/1996 Kast ..... A63G 31/16 137/128
7,125,074 B2 * 10/2006 Real ..... A47C 7/72 297/217.3
7,520,469 B2 * 4/2009 Baumann ..... B64D 11/06 244/122 R
2004/0035347 A1 * 2/2004 Grober ..... B63B 29/12 114/191

(Continued)

FOREIGN PATENT DOCUMENTS

JP 2011156052 A * 10/2011
TW M350297 2/2009
TW M363925 9/2009

*Primary Examiner* — Robert Canfield
(74) *Attorney, Agent, or Firm* — JCIPRNET

(57) ABSTRACT

A swing chair includes a base, a seat, and a driving frame. The seat is disposed above the base. The driving frame is disposed between the base and the seat. The driving frame includes a first fixing base, a first shaft, a second fixing base, a second shaft, a first driving assembly, and a second driving assembly. The first fixing base is fixed to the base. The first shaft is rotatably connected to the first fixing base. The second fixing base is fixed to the seat. The second shaft is connected to the first shaft and the second fixing base is rotatably connected to the second shaft. The first driving assembly is configured to drive the first shaft to rotate with respect to the first fixing base. The second driving assembly is configured to drive the second fixing base to rotate with respect to the second shaft.

10 Claims, 3 Drawing Sheets

(56) References Cited

U.S. PATENT DOCUMENTS

| | | | | |
|---|---|---|---|---|
| 2006/0121420 | A1* | 6/2006 | Athanas | G09B 9/165 434/31 |
| 2008/0039216 | A1* | 2/2008 | Higashiguchi | A63F 13/803 463/47 |
| 2009/0278388 | A1* | 11/2009 | Reingewirtz | A47C 3/025 297/217.2 |
| 2012/0315985 | A1* | 12/2012 | Granger | G07F 17/3216 463/31 |
| 2013/0316826 | A1* | 11/2013 | Levanon | A63F 13/08 463/36 |

* cited by examiner

SWING CHAIR

CROSS-REFERENCE TO RELATED APPLICATION

This application claims the priority benefit of Taiwan application serial no. 107146725, filed on Dec. 24, 2018. The entirety of the above-mentioned patent application is hereby incorporated by reference herein and made a part of this specification.

BACKGROUND

Technical Field

The disclosure relates to a chair, and more particularly to a swing chair.

Description of Related Art

Due to changes in work styles and recreational activities, modern people spend a significant amount of time seating on chairs to handle office work, personal affairs, or play video games. In general, most conventional office chairs, computer chairs, or e-sports chairs have freedom of movement for rotation perpendicular to the ground, while some other office chairs, computer chairs, or e-sports chairs can withstand force to be leaned backward. However, to produce all of these movements, force has to be applied through the seater or others to the office chair, the computer chair, or the e-sports chair.

SUMMARY

The disclosure provides a swing chair, which can automatically rotate around two different axes.

The swing chair of the disclosure includes a base, a seat, and a driving frame. The seat is disposed above the base. The driving frame is disposed between the base and the seat. The driving frame includes a first fixing base, a first shaft, a second fixing base, a second shaft, a first driving assembly, and a second driving assembly. The first fixing base is fixed to the base. The first shaft is rotatably connected to the first fixing base. The second fixing base is fixed to the seat. The second shaft is connected to the first shaft and the second fixing base is rotatably connected to the second shaft. The first driving assembly is configured to drive the first shaft to rotate with respect to the first fixing base. The second driving assembly is configured to drive the second fixing base to rotate with respect to the second shaft.

Based on the above, the swing chair of the disclosure can automatically rotate around two different axes to provide the seater with a better seating experience.

To make the aforementioned and other features of the disclosure more comprehensible, several embodiments accompanied with drawings are described in detail as follows.

DETAILED DESCRIPTION OF DISCLOSED EMBODIMENTS

Figure 1:
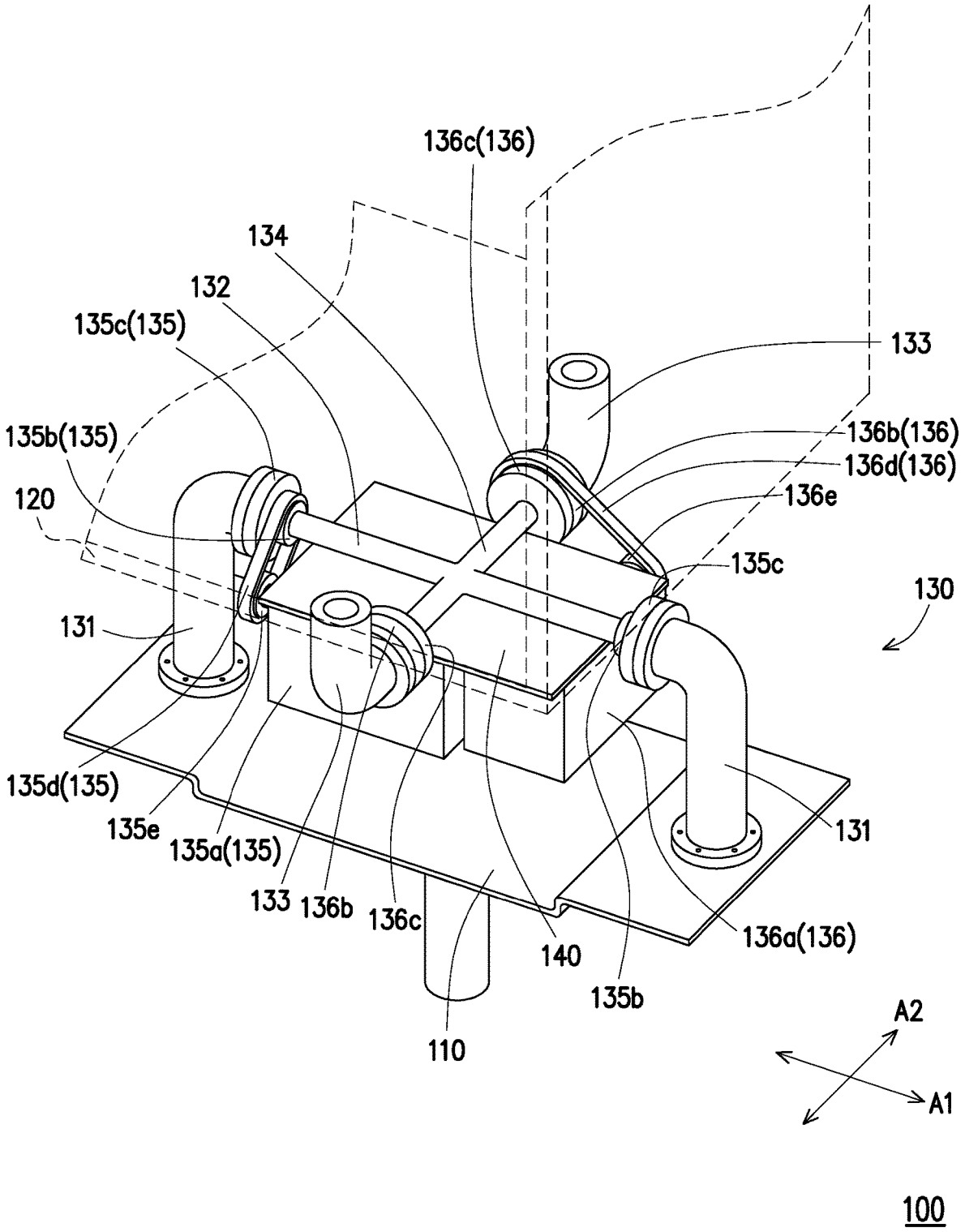
FIG. 1 is a schematic view of a swing chair according to an embodiment of the disclosure.
Figure 2:
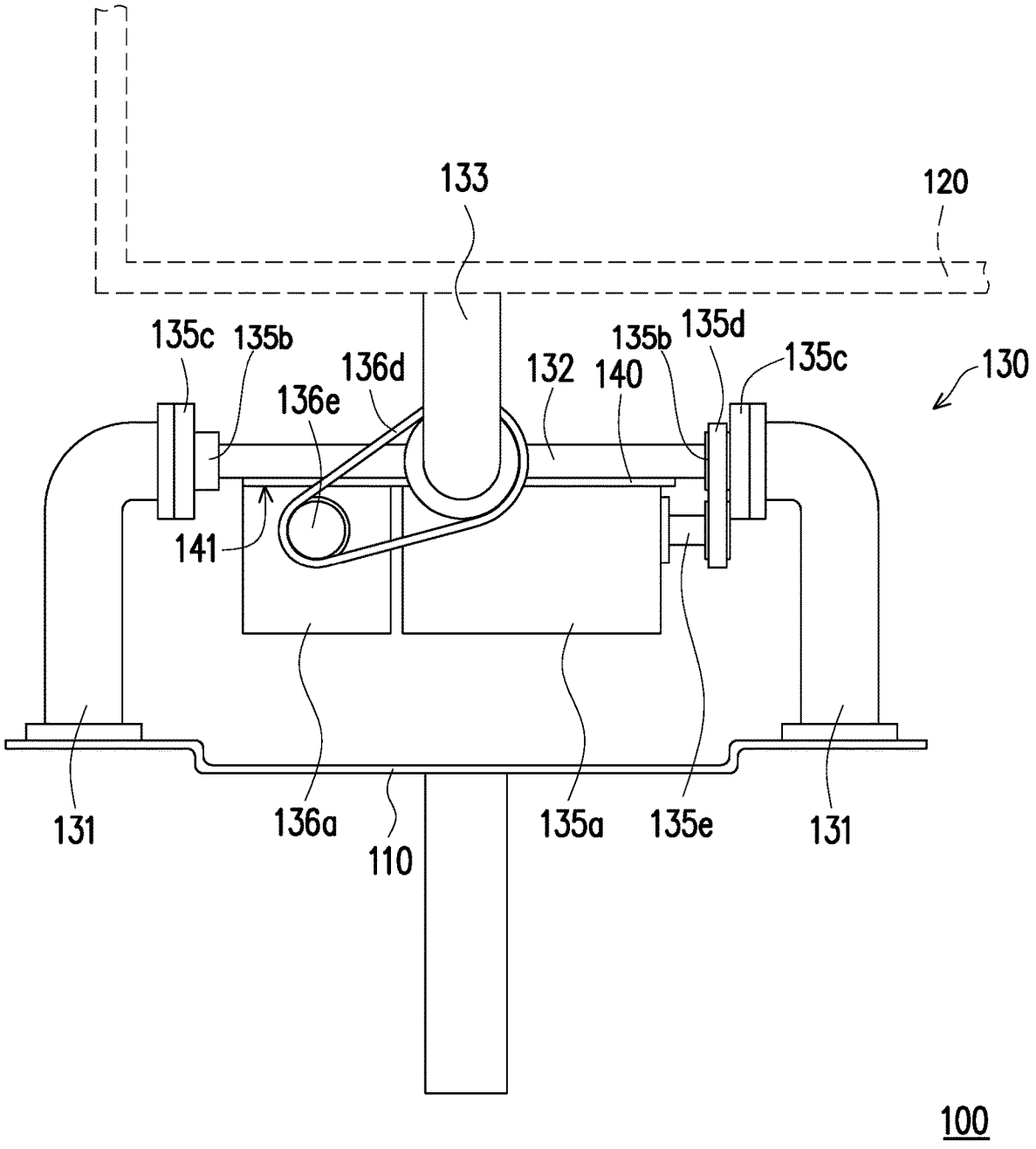
FIG. 2 is a schematic view of a side view of the swing chair of FIG. 1.

FIG. 1 is a schematic view of a swing chair according to an embodiment of the disclosure. FIG. 2 is a schematic view of a side view of the swing chair of FIG. 1. Referring to FIG. 1 and FIG. 2, in the embodiment, a swing chair 100 is applicable for e-sports or virtual reality games to provide the player with a better seating experience and an immersive interactive experience. For example, the swing chair 100 may interact with the game console to cooperate with the game scenarios to produce movements such as leaning forward and backward or slanting leftward and rightward, thereby enabling the player sitting on the swing chair 100 to be immersed in the game.

Furthermore, the swing chair 100 includes a base 110, a seat 120, and a driving frame 130, wherein the driving frame 130 is disposed between the base 110 and the seat 120, and the seat 120 is supported by the driving frame 130 to be disposed above the base 110. The base 110 may be fixed to the ground, slide with respect to the ground or rotate around the axial direction perpendicular to the ground. The driving frame 130 is configured to drive the seat 120 to lean forward and backward or slant leftward and rightward with respect to the base 110.

In the embodiment, the driving frame 130 includes a first fixing base 131, a first shaft 132, a second fixing base 133, a second shaft 134, a first driving assembly 135, and a second driving assembly 136, wherein the first driving assembly 135 is configured to provide power to drive the seat 120 to slant leftward and rightward with respect to the base 110, and the second driving assembly 136 is configured to provide power to drive the seat 120 to lean forward and backward with respect to the base 110. On the other hand, the number of the first fixing base 131 may be two and the first fixing bases 131 are fixed to the two opposite sides of the base 110. The two opposite ends of the first shaft 132 are rotatably connected to the two first fixing bases 131 respectively. Accordingly, the number of the second fixing base 133 may be two and the second fixing bases 133 are fixed to the two opposite sides of the seat 120. The two opposite ends of the second shaft 134 are respectively connected to the two second fixing bases 133 and the two second fixing bases 133 can rotate with respect to the second shaft 134. In other words, the first shaft 132 serves as the rotational reference for the seat 120 to slant leftward and rightward with respect to the base 110, and the second shaft 134 serves as the rotational reference for the seat 120 to lean forward and backward with respect to the base 110.

From the above, the second shaft 134 is connected to the first shaft 132 and may be an integrally formed cross-shaped structure. On the other hand, the first driving assembly 135 is configured to drive the first shaft 132 to rotate with respect to the two first fixing bases 131 and the second driving assembly 136 is configured to drive the two second fixing bases 133 to rotate with respect to the second shaft 134. During the rotation of the first shaft 132 with respect to the two first fixing bases 131, the two second fixing bases 133, the second shaft 134, and the second driving assembly 136 rotate with the first shaft 132 around a first axial direction A1 to drive the seat 120 to slant leftward and rightward with respect to the base 110. In contrast, during the rotation of the two second fixing bases 133 with respect to the second shaft 134, the seat 120 rotates with the two second fixing bases 133 around a second axial direction A2 to drive the seat 120 to lean forward and backward with respect to the base 110. Furthermore, the first axial direction A1 and the second axial direction A2 are perpendicular to each other, wherein the first axial direction A1 is parallel to the first shaft 132 and the second shaft 134 is parallel to the second axial direction A2.

In the embodiment, the first driving assembly 135 includes a first motor 135*a*, a first driven member 135*b*, a first bearing 135*c*, and a first linking member 135*d*, wherein the number of the first bearing 135*c* may be two and the number of the first driven member 135*b* may be two. The two first bearings 135*c* are respectively fixed to the two first fixing bases 131 and the two first driven members 135*b* are respectively fixed to the two first bearings 135*c*. For example, each of the first bearings 135*c* is fixed to the corresponding first fixing base 131 with an outer ring, wherein each of the first driven members 135*b* is fixed to the outer ring of the corresponding first bearing 135*c* and the two opposite ends of the first shaft 132 respectively passes through the two first driven members 135*b* to connect to inner rings of the two first bearings 135*c*. In other words, each of the first driven members 135*b* cannot rotate with respect to the corresponding first fixing base 131, but the first shaft 132 can rotate with respect to the two first fixing bases 131 through the two first bearings 135*c*. From the above, the first driven member 135*b* is a pulley and the first linking member 135*d* is a belt. The first linking member 135*d* is coupled to one of the two first driven members 135*b* and a power output shaft 135*e* of the first motor 135*a*. Since the first motor 135*a* of the embodiment is fixed to the first shaft 132 and each of the first driven members 135*b* cannot rotate with respect to the corresponding first fixing base 131, the power output shaft 135*e* cannot drive the first linking member 135*d* during the operation of the first motor 135*a*, thereby causing the first motor 135*a* to produce self-rotation to drive the first shaft 132 to rotate with respect to the two first fixing bases 131 through the two first bearings 135*c*.

On the other hand, the second driving assembly 136 includes a second motor 136*a*, a second driven member 136*b*, a second bearing 136*c*, and a second linking member 136*d*, wherein the number of the second driven member 136*b* may be two and the number of the second bearing 136*c* may be two. The two second driven members 136*b* are respectively fixed to the two second fixing bases 133 and the two second bearings 136*c* are respectively fixed to the two second driven members 136*b*. For example, each of the second bearings 136*c* is fixed to the corresponding second driven member 136*b* with an outer ring and the two opposite ends of the second shaft 134 are respectively connected to inner rings of the two second bearings 136*c*. In other words, the two second driven members 136*b* are respectively connected to the second shaft 134 through the two second bearings 136*c* and each of the second fixing bases 133 and the corresponding second driven member 136*b* can rotate with respect to the second shaft 134 through the corresponding second bearing 136*c*.

From the above, the second driven member 136*b* is a pulley and the second linking member 136*d* is a belt. The second linking member 136*d* is coupled to one of the two second driven members 136*b* and a power output shaft 136*e* of the second motor 136*a*. During the operation of the second motor 136*a*, the power output shaft 136*e* drives the second linking member 136*d* to drive one of the second driven second driven members 136*b* to rotate with respect to the second shaft 134, thereby causing the two second fixing bases 133 to rotate with the second driven member 136*b* with respect to the second shaft 134.

Continue to refer to FIG. 1 and FIG. 2, in the embodiment, the swing chair 100 further includes a carrier 140 fixed to the first shaft 132, wherein the first motor 135*a* and the second motor 136*a* are fixed to a surface 141 of the carrier 140 facing the base 110, the power output shaft 135*e* of the first motor 135*a* and the power output shaft 136*e* of the second motor 136*a* are located on the same plane, and the plane is parallel to the surface 141 of the carrier 140 facing the base 110. Since the power output shaft 135*e* of the first motor 135*a* and the power output shaft 136*e* of the second motor 136*a* are located on the same plane, the required configuration space between the seat 110 and the base 120 can be greatly reduced.

Figure 3:
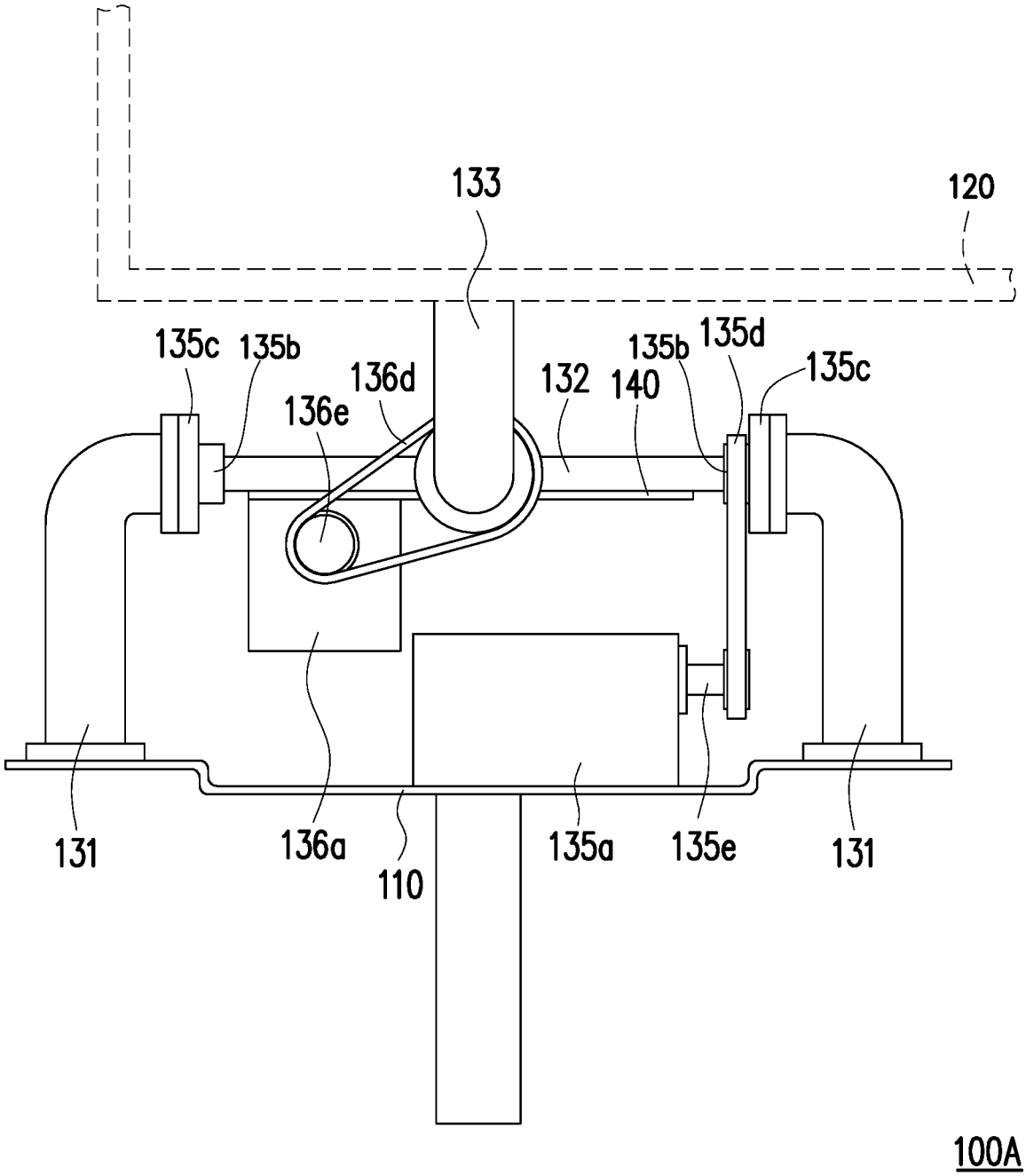
FIG. 3 is a schematic view of a swing chair according to another embodiment of the disclosure.

FIG. 3 is a schematic view of a swing chair according to another embodiment of the disclosure. Referring to FIG. 3, unlike the above embodiment, a first motor 135*a* of a swing chair 100A of the present embodiment is fixed to a base 120. In other words, a power output shaft 135*e* of the first motor 135*a* and a power output shaft 136*e* of the second motor 136*a* are located on different planes. The two first driven members 135*b* are respectively fixed to the two opposite ends of the first shaft 132 and the first shaft 132 is connected to the two first bearings 135*c* through the two first driven members 135*b*. For example, each of the first bearings 135*c* is fixed to the corresponding first fixing base 131 with an outer ring, wherein each of the first driven members 135*b* is fixed to an inner ring of the corresponding first bearing 135*c*.

In other words, the first shaft 132 can rotate with respect to the two first fixing bases 131 through the two first driven members 135*b*.

During the operation of the first motor 135*a*, the power output shaft 135*e* drives the first linking member 135*d* to drive one of the first driven members 135*b* to rotate with respect to the corresponding first fixing base 131, thereby causing the first shaft 132 to rotate with first driven member 135*b* with respect to the two first fixing bases 131.

Based on the above, the swing chair of the disclosure is applicable for e-sports or virtual reality games to provide the player with a better seating experience and an immersive interactive experience. For example, the swing chair may interact with the game console to cooperate with the game scenarios to automatically rotate around the two different axes or produce movements such as leaning forward and backward or slanting leftward and rightward, thereby enabling the player sitting on the swing chair to be immersed in the game. In addition, the swing chair provides power sources for movements such as leaning forward and backward or slanting leftward and rightward through the two motors respectively, so the movements such as leaning forward and backward or slanting leftward and rightward may be synchronously produced or asynchronously produced. Secondly, since the two power output shafts of the two motors are located on the same plane, the required configuration space between the seat and the base can be greatly reduced.

It may be apparent to those skilled in the art that various modifications and variations may be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A swing chair, comprising:

a base;

a seat, disposed above the base; and a driving frame, disposed between the base and the seat, wherein the driving frame comprises:

a first fixing base, fixed to the base;

a first shaft rotatably, connected to the first fixing base;

a second fixing base, fixed to the seat;

a second shaft, connected to the first shaft, and the second fixing base is rotatably connected to the second shaft;

a first driving assembly, coupled to the first shaft to drive the first shaft to rotate with respect to the first fixing base; and a second driving assembly, coupled to the second fixing base to drive the second fixing base to rotate with respect to the second shaft, wherein a central axis of the first shaft and a central axis of the second shaft are located on a same plane.

2. The swing chair according to claim 1, wherein the first shaft and the second shaft are perpendicular to each other.

3. The swing chair according to claim 1, wherein the first driving assembly comprises:

a motor, fixed to the first shaft;

a bearing, fixed to the first fixing base;

a driven member, fixed to the bearing, and the first shaft is connected to the bearing; and a linking member, coupled to the motor and the driven member.

4. The swing chair according to claim 3, wherein the linking member comprises a belt and the driven member comprises a pulley.

5. The swing chair according to claim 1, wherein the first driving assembly comprises:

a motor, fixed to the base;

a bearing, fixed to the first fixing base;

a driven member, fixed to the first shaft, and the first shaft is connected to the bearing through the driven member; and a linking member, coupled to the motor and the driven member.

6. The swing chair according to claim 5, wherein the linking member comprises a belt and the driven member comprises a pulley.

7. The swing chair according to claim 1, wherein the second driving assembly comprises:

a motor, fixed to the first shaft;

a driven member, fixed to the second fixing base;

a bearing, fixed to the driven member, and the driven member is connected to the second shaft through the bearing; and a linking member, coupled to the motor and the driven member.

8. The swing chair according to claim 7, wherein the linking member comprises a belt and the driven member comprises a pulley.

9. The swing chair according to claim 1, further comprising a carrier fixed to the first shaft, wherein the first driving assembly comprises a first motor and the second driving assembly comprises a second motor, and the first motor and the second motor are fixed to the carrier.

10. The swing chair according to claim 9, wherein a power output shaft of the first motor and a power output shaft of the second motor are located on a same plane.

* * * * *